US006635199B2

(12) United States Patent
Yamanaka et al.

(10) Patent No.: US 6,635,199 B2
(45) Date of Patent: Oct. 21, 2003

(54) PROCESS FOR PRODUCING A PRECURSOR FIBER BUNDLE AND A CARBON FIBER BUNDLE

(75) Inventors: Shuichi Yamanaka, Ehime (JP); Masakatsu Shinto, Ehime (JP); Haruki Morikawa, Shiga (JP); Toshiyuki Miyoshi, Ehime (JP); Keizo Ono, Ehime (JP); Makoto Endo, Ehime (JP); Jun Yamazaki, Ehime (JP)

(73) Assignee: Toray Industries, Inc., Tokyo (JP)

( * ) Notice: Subject to any disclaimer, the term of this patent is extended or adjusted under 35 U.S.C. 154(b) by 292 days.

(21) Appl. No.: 09/883,544

(22) Filed: Jun. 18, 2001

(65) Prior Publication Data

US 2001/0049016 A1 Dec. 6, 2001

Related U.S. Application Data

(62) Division of application No. 08/947,722, filed on Oct. 9, 1997, now Pat. No. 6,294,252.

(30) Foreign Application Priority Data

Oct. 14, 1996 (JP) ..... 8-289062

(51) Int. Cl.[7] ..... D01D 5/16; D01F 9/20; D02G 3/02

(52) U.S. Cl. ..... 264/29.2; 264/103; 264/168; 264/210.8; 423/447.6; 423/447.7

(58) Field of Search ..... 264/29.2, 103, 264/168, 210.8; 423/447.6, 447.7; 28/247, 263; 226/1

(56) References Cited

U.S. PATENT DOCUMENTS

| | | | | |
|---|---|---|---|---|
| 3,671,619 A | | 6/1972 | Fitzgerald et al. | |
| 3,763,520 A | * | 10/1973 | Izawa et al. | 226/1 |
| 3,999,695 A | * | 12/1976 | Bradley et al. | 226/1 |
| 4,008,344 A | | 2/1977 | Okamoto et al. | |
| 4,265,082 A | | 5/1981 | Sasaki et al. | |
| 4,452,860 A | | 6/1984 | Obama et al. | |
| 4,460,650 A | | 7/1984 | Ogawa et al. | |
| 4,476,186 A | | 10/1984 | Kato et al. | |
| 5,049,419 A | | 9/1991 | Kyono et al. | |
| 5,269,984 A | | 12/1993 | Ono et al. | |
| 5,286,553 A | | 2/1994 | Haraguchi et al. | |
| 5,407,739 A | | 4/1995 | McCullough et al. | |
| 5,582,912 A | | 12/1996 | McCullough, Jr. et al. | |
| 5,747,137 A | | 5/1998 | Cutolo et al. | |
| 5,783,278 A | | 7/1998 | Nishimura et al. | |

FOREIGN PATENT DOCUMENTS

JP 56-4724 A 1/1981

OTHER PUBLICATIONS

Chemical Dictionary, By Roger and Claire Grant, 5$^{th}$ Edition, p. 30 (1987).

* cited by examiner

*Primary Examiner*—Leo B. Tentoni
(74) *Attorney, Agent, or Firm*—Piper Rudnick LLP

(57) ABSTRACT

A separable tow of elongated polymeric filaments comprises a plurality of distinct sub-tows lightly and individually and separably joined, as by light crimping together along their edges or, if uncrimped, joined by presence of moisture, and capable of being packed into a container and later removed and separated. The filaments are preferably acrylic and have a total fineness of about 300,00–1,500,000 denier and the sub-tows each of which has a total fineness of about 50,000–250,000 denier, with a filament fineness of about 1–2 denier, and each sub-tow has a degree of entanglement of about 10–40 $m^{-1}$ as measured by the hook drop test.

The separable tow is made of a plurality of sub-tows, after separately drawing the sub-tows and subsequently removably joining the sub-tows into a single tow.

9 Claims, 1 Drawing Sheet

PROCESS FOR PRODUCING A PRECURSOR FIBER BUNDLE AND A CARBON FIBER BUNDLE

This application is a divisional of Application Ser. No. 08/947,722, filed Oct. 9, 1997, now U.S. Pat. No. 6,294,252 incorporated herein by reference.

BACKGROUND OF THE INVENTION

The present invention relates to a precursor fiber bundle to be processed into a carbon fiber bundle, a process for producing the precursor fiber bundle, a carbon fiber bundle, and a process for producing the carbon fiber bundle. In more detail, the present invention relates to a precursor fiber bundle to be processed into a carbon fiber bundle, which is low in production cost, excellent in productivity, and which experiences less fiber breakage and fuzz generation, and which can be transformed into a sub-tow having an optimum formation for supplying to a process for producing a carbon fiber bundle. This invention also relates to a process for producing the precursor fiber bundle, to a carbon fiber bundle prepared from the sub-tow, and to a process for producing the carbon fiber bundle.

Furthermore, the present invention relates to a precursor fiber bundle comprising an acrylic polymer processed into a carbon fiber bundle, a process for producing the same, a carbon fiber bundle obtained from the precursor fiber bundle, and a process for producing the carbon fiber bundle.

Conventional precursor fiber bundle to be processed into a carbon fiber bundle is made of an acrylic polymer. The fiber bundle filaments may number from 3,000 to 20,000, and have a fineness of from 1,000 denier to 24,000 denier with small occurrences of fiber breakage and fuzz. It has been used for production of carbon fiber bundles having high strength and high modulus.

The precursor fiber bundle comprising an acrylic polymer processed into a carbon fiber bundle have been widely used as reinforcing fibers for components in the field of aerospace, sports, etc. The conventional carbon fiber bundle has been mainly examined to enhance its strength and the elastic modulus of carbon fibers. Specific items of examination include degree of crystalline orientation and densifying property of the precursor fibers, single filament breakage, fuzz, adhesion between filaments, acceleration of stabilization of the precursor fibers, etc.

The utilization of carbon fibers is being expanded at a rapid pace into general industrial fields including automobiles, civil engineering, architecture, energy, compounds, etc., and it is advantageous to supply a raw fiber bundle (precursor fiber bundle) to be processed into a carbon fiber bundle as a multifilament having improved strength and elastic modulus, at lower cost, and with increased productivity.

However, the raw fiber bundle (precursor fiber bundle) intended to be processed into a carbon fiber bundle is actually produced as a multifilament and wound on a drum or bobbin, and supplied in this style to a process for producing a carbon fiber bundle. Due to restrictions in the process of producing the carbon fiber bundle, particularly restriction of thickness (fineness) of the precursor fiber bundle in the stabilizing process, the rate of productivity has been kept remarkably low.

That is, the precursor fiber bundle comprising an acrylic polymer, processed into a carbon fiber bundle, is heated in an oxidizing atmosphere having a temperature of from 200° C. to 350° C. for stabilizing prior to carbonizing treatment.

The stabilization treatment causes oxidization and cyclization, but since it generates heat, the heat stored in the fiber bundle becomes an important factor. If the heat stored in the fiber bundle is excessive, fiber breakage and adhesion between filaments occur. So, the stored heat must be kept low enough to prevent this.

Accordingly, a precursor fiber bundle having excessive thickness cannot be supplied into the stabilizing furnace. In industrial production the precursor fiber bundle is accordingly restricted in thickness (fineness). The restriction unfortunately keeps productivity low and is an obstacle in reducing production cost.

Producing a thermoplastic synthetic fiber bundle as a raw fiber bundle to be processed into a spun yarn or a non-woven fabric, not as a precursor fiber bundle to be processed into a carbon fiber bundle, is disclosed in Japanese Patent Laid-Open (Kokai) No. 56-4724. In this process, a tow running into a crimping apparatus is divided by dividing pins located close to the entrance of the crimping apparatus. A plurality of divided sub-tows are simultaneously supplied into the crimping apparatus, so that the plurality of sub-tows may be crimped as a whole, to be collected as one crimped tow capable of being potentially divided into crimped sub-tows later. However, if this process is applied to production of a precursor fiber bundle intended to be processed into a carbon fiber bundle, fiber breakage occurs often. This lowers the grade of the product since it is necessary to divide into a plurality of sub-tows a precursor fiber bundle having a fineness of not less than 300,000 denier in which filaments are engaged with each other by mutual oblique crossing and are closed up each other. This also adversely affects the production of carbon fibers.

SUMMARY OF THE INVENTION

An object of the present invention is to provide a precursor fiber bundle that can effectively and efficiently to be processed into a carbon fiber bundle which can be larger in thickness, i.e., in fineness to provide high productivity and low production cost, and which can be easily divided into sub-tows, each of which has a thickness (fineness) as required for producing a carbon fiber bundle, considering the restriction of thickness (fineness) of the fiber bundle in the process.

A further object of the present invention is to provide a process for producing the precursor fiber bundle, and the resulting carbon fiber bundle, and a process for producing the carbon fiber bundle. Hereinafter in this specification, the expression "precursor fiber bundle" means a precursor fiber bundle adapted to be processed into a carbon fiber bundle or a precursor fiber bundle for production of a carbon fiber bundle.

The precursor fiber bundle of the present invention can be kept in the form of one single tow when packed in a container, and can potentially be divided into a plurality of sub-tows when taken out of its container and used for producing a carbon fiber bundle.

The precursor fiber bundle of the present invention is an acrylic polymer fiber tow having the total fineness of about 300,000 denier to 1,500,000 denier, and preferably having a number of filaments of from about 50,000 to about 1,000,000, which can be potentially divided into sub-tows each of which has a fineness of from about 50,000 denier to about 250,000 denier.

The precursor fiber bundle may also be a crimped tow or a non-crimped tow. In the case of a non-crimped tow, its moisture content is preferably in the range of from about 10% to about 50%.

Furthermore, the degree of entanglement of each of the sub-tows divided from the precursor fiber bundle is preferably in the range of from about 10 $m^{-1}$ to about 40 $m^{-1}$, measured according to the well-known hook drop testing method. Where the degrees of entanglement are in that range, the precursor fiber bundle e.g. the original tow can be easily divided into a plurality, each of which is used for producing a useful carbon fiber bundle.

The process for producing a precursor fiber bundle having the above properties comprises the steps of dividing a fiber bundle consisting of a plurality of spun filaments into a plurality of sub-tows in such a way that each sub-tow comprises a predetermined number of filaments; drawing the filaments while in this state of division; collecting the plurality of drawn sub-tows into one tow potentially capable of being divided into a plurality of sub-tows when used for producing a carbon fiber bundle; and packing the product into a container. In this process, a plurality of groups each of which consist of a plurality of sub-tows may also be arranged to run in parallel each other.

The process for producing a carbon fiber bundle according to the present invention may also comprise the steps of dividing the precursor fiber bundle into a plurality of sub-tows; and subjecting the sub-tows to a stabilizing process and to a carbonizing process.

According to the present invention, the filaments taken up from a spinnerette are divided into a plurality of sub-tows, and the respective sub-tows are then collected into a single tow that is capable of being potentially divided into a plurality of sub-tows when used later for producing a carbon fiber bundle, and before they are packed into a container.

The precursor fiber bundle formed as a single tow is packed into a container, since the tow production speed is greatly different than the treatment speed of the subsequent carbonizing process. In the carbon fiber production process, the precursor fiber bundle formed as a single tow is taken out of the container and fed to a stabilizing process. In this case, it is divided into a plurality of sub-tows each of which has a predetermined thickness, before it is fed to the stabilizing process. Therefore, the problem of excessively stored heat, as described before, can be prevented from occurring, and carbon fibers that have the desired high strength and high modulus can be produced efficiently. In the final stage of the process for producing the precursor fiber bundle, the filaments are formed as one fiber bundle having a large total fineness, but the carbon fiber bundle after it has been produced is divided into a plurality of sub-tows each of which has a fineness suitable for stabilizing and carbonizing. Accordingly, the production of the precursor fiber bundle, and the production of the carbon fiber bundle can be carried out under remarkably efficient conditions.

The precursor fiber bundle of the present invention is preferably made of an acrylic polymer containing acrylonitrile, one or more unsaturated monomers selected from the following group A, and one or more unsaturated monomers selected from the following group B. They are present in amounts shown in the following equations (1), (2) and (3).

Group A comprises one or more unsaturated monomers selected from the group consisting of vinyl acetate, methyl acrylate, methyl methacrylate and styrene.

Group B comprises one or more unsaturated monomers selected from a group consisting of itaconic acid and acrylic acid.

The amounts are:

$$AN\ (wt\ \%) \geqq 86 \quad (1)$$

$$3 \leqq A\ (wt\ \%) \leqq 10 \quad (2)$$

$$0.25A-0.5 \leqq B\ (\text{wt}\ \%) \leqq 0.43A-0.29 \quad (3)$$

The symbols in the above formulae stand for the following:

AN represent the acrylonitrile content (wt %) in the acrylic polymer.

A represent the content (wt %) of the unsaturated monomer selected from said group A in the acrylic polymer (total weight of unsaturated monomers when a plurality of unsaturated monomers are present)

B represent the content (wt %) of the unsaturated monomer selected from said group B in the acrylic polymer (total weight of unsaturated monomers when a plurality of unsaturated monomers are present)

As shown by the formula (2), the weight percent (content) of the unsaturated monomer selected from said group A is in the range of from about 3 wt % to about 10 wt %. If the amount is less than about 3 wt %, the filaments are slightly less likely to stretch when drawn, and the tension in the stabilizing process is too high. If said amount is more than about 10 wt %, more filaments adhere to each other when stabilized, and carbonization at a lower temperature at a lower speed is required to prevent it. This raises production cost.

Furthermore, as shown in the formula (3), the weight percent B of the unsaturated monomer B is in the range of about (0.25×A−0.5) wt % to about (0.43×A−0.29) wt %. If the amount is less than the lower limit, acceleration of stabilization does not occur. If the amount is more than the upper limit, acceleration of stabilization becomes less efficient; this raises production cost.

The acrylic polymer may be produced by any known polymerization method such as suspension polymerization, solution polymerization or emulsion polymerization, etc. The polymerization degree is preferably about 1.0 or more expressed as intrinsic viscosity ([η]). The upper limit of intrinsic viscosity ([η]) is desirably about 3.0 or less since otherwise the production of the spinning dope itself is difficult, and since otherwise the spinning stability of the polymer is also remarkably lowered. The expression "intrinsic viscosity" refers to the value measured at 25° C. with dimethylformamide as the solvent.

The solution of the acrylic polymer, i.e., the spinning dope, is spun into an acrylic polymer fiber bundle using a coagulating bath of an organic solvent or water.

Spinning may be wet spinning in which a spinning dope is ejected from a spinnerette emersed in a coagulating bath, or may be semi-wet spinning in which a spinning dope is ejected from a spinnerette installed above the liquid surface of a coagulating bath with a distance between them, into air or inactive gas and introduced into the coagulating bath, or may be melt spinning.

In spinning using a solvent and plasticizer, the spun filaments may be drawn into a bath immediately, or after having been washed with water to remove the solvent and plasticizer.

The acrylic polymer fiber bundle obtained by any of these methods is drawn with a draw ratio in the range of from about 2 times to about 8 times in a drawing bath having a temperature of from about 50° C. to about 98° C. If the drawing ratio is too low, good densifying cannot be obtained, leaving voids, and the physical properties are likely to be poor. If the draw ratio is more than about 8 times, the tension during carbonization increases, requiring a larger apparatus. Drawing in a steam tube may be used with drawing in a bath, but in the case of drawing in a steam tube, it is preferable to keep the drawing ratio low to suppress orientation of fibers. However, drawing in a bath only is preferable.

Turning now to the number of filaments of the acrylic polymer fiber bundle, it is preferable to use a multifilament comprising a number of filaments in the range of from about $5\times10^4$ filaments to about $1\times10^6$ filaments to enhance production efficiency and cost reduction.

Subsequently, the filaments are dried under gentle air flow having a temperature in the range of from about 110° C. to about 180° C. or a heating roller under tension or relaxation, and are densified simultaneously. Prior to the drying and densifying, it is desirable to apply a proper oiling treatment to prevent adhesion between filaments and to facilitate handling of the dried and densified fiber bundle.

The dried and densified fiber bundle is shrunken at a ratio of about 5% to about 18%. The shrinking treatment is intended to shrink the filaments under proper tension using a heating roller or any other heating means such as hot air, and this is effective to decrease the tension acting on the fiber bundle in the subsequent stabilizing process. For decreasing tension, a shrink treatment having a ratio of about 5% to about 18% is important. The heating temperature is in the range of about 80° C. to about 120° C., and it is preferable to maintain substantially no tension, but some tension may be applied for the convenience of process if it allows enough shrinkage to be achieved. The percentage of shrinkage may be controlled by combining the heat treatment temperature, the residence time and the tension. The fineness (d) of each of the filaments finally obtained is preferably in the range of about 1 denier to about 2.0 deniers, more preferably from about 1.0 denier to about 1.5 deniers, for higher productivity.

The precursor fiber bundle obtained as described above may be processed into a carbon fiber bundle by any conventional method. The stabilizing conditions in this case may be as in conventional methods. The fiber bundle is treated in an oxidizing atmosphere having a temperature in the range of about 200° C. to about 300° C. under tension or while being drawn.

The shrinkage stress during stabilization of the acrylic polymer fiber bundle is related to the potential physical properties of the resulting carbon fiber bundle. When the raw fibers are higher in strength, that is, more highly oriented with greater shrinkage stress, the potential physical properties of the carbon fibers obtained are greater. However, in order to obtain such physical properties, it is desirable to control the shrinkage of fibers or to apply high tension to the fibers by drawing.

To obtain the physical properties of reinforcing carbon fibers for general industrial applications, high tension treatment is not required so much, and the problem in commodity design is to produce carbon fibers with good cost performance which can compete in price with conventional materials such as glass fibers, iron and aluminum.

Conventionally, carbon fibers having great tensile strength are generally produced by stabilizing precursor fibers with a high capability of shrinkage stress at a high tension, to produce, as an intermediate product, oxidized fibers (stabilized fibers) having a high degree of crystalline orientation and a high tensile strength. In such a high tension process, the occurrences of fuzz and breakage of fibers are likely to reduce quality and processability. The production conditions and equipment conditions are accordingly varied in an effort to prevent this. However, such approaches tend to raise the production cost of carbon fibers significantly.

On the contrary, according to the present invention, styrene, methyl acrylate or methyl methacrylate as a polymerizable unsaturated monomer is added to the acrylic polymer fibers, thereby achieving reduced shrinkage stress, thereby allowing the tension in the stabilizing process also to be reduced. The tension in the stabilizing process can be kept low, thus minimizing the occurrences of fiber breakage and fuzz in the stabilizing process.

Furthermore, a carbon fiber bundle of about 25,000 deniers or more in fineness, substantially having no twist, and of from about 10 $m^{-1}$ to about 100 $m^{-1}$ in the degree of entanglement measured according to the hook drop test can be obtained. Its physical properties are in the range of from about 2.0 GPa to about 5.0 GPa, preferably from about 3.0 GPa to about 4.5 GPa in tensile strength and in the range of from about 200 GPa to about 300 GPa in elastic modulus. These carbon fibers may be used for general purpose. Herein, the expression "substantially no twist" means the twist count per meter is not more than 1 turn of twist.

It is preferable that the tension T in the stabilizing process approximately satisfies the following formula (4).

$$30 \leqq T\ (\mathrm{mg/d}) \leqq 120 \tag{4}$$

More preferably, the tension T is in the range of from about 60 mg/d to about 100 mg/d. If the tension T is less than about 30 mg/d, the tension is so low as to shrink the fibers, and to lower the degree of crystallite orientation, and the fibers obtained are low in tensile strength. If the tension T is more than about 120 mg/d, good physical properties can be obtained, but since the tension is so high, the return rollers must be especially strong or of large diameter. The equipment must be so heavy as to be industrially undesirable. If return rollers that are large in diameter are installed for the stabilizing furnace, it is difficult to achieve a high frequency return, making mass processing difficult. Also in view of this, it is not desirable to keep the tension excessive.

In the present invention, since the tension T in the stabilizing process is controlled to low range of about 30 mg/d to about 120 mg/d, the load per unit filaments acting on the rollers is light, and unprecedented consistent carbon fiber production allows very favorable mass processing. Therefore, no equipment of excessive size is necessary; general purpose carbon fibers can be produced using inexpensive equipment, and very advantageously in view of reducing product cost. As a result, carbon fibers may now be used for applications where they could not have been used because of high cost.

The effect of cost reduction by achieving low tension is further described below.

Firstly, cost reduction can be obtained through process stability. A lower tension is effective for decreasing the creation of fuzz and fiber breakage in the strand formed as an aggregate of many short fibers during processing. Hence, the process is very effective to decrease production mishaps such as the seizure of filaments and the strand on the rollers. The amount of generated fuzz is directly related to processability. The low tension also has a good minimizing effect upon the amount of fuzz. The amount of fuzz created is a good indicator for evaluating the overall processability of the method.

Secondly, an important cost reduction can be obtained through the enhanced volume availability in the stabilizing furnace. In the carbon fiber production process, since a strand to be processed is continuously processed, a series of rollers is usually used. Since these rollers are deflected in response to the tension of the strand, a deflection which poses no problem in equipment or process stability is achieved by this invention. In the case of a cylindrical roller of uniform diameter, the maximum deflection is proportional to the product of the tension and the 4th power of (roller length L/roller diameter D). Therefore, in general, if the tension is doubled, the deflection is doubled, and to lower the doubled deflection to the original deflection, the diameter must be increased to 1.2 times. The diameter of a roller especially directly affects the volume availability of the stabilizing furnace; and if the diameter of a roller is decreased, the volume availability of the stabilizing furnace is higher, and this significantly enhances carbon fiber productivity.

DESCRIPTION OF THE PREFERRED EMBODIMENTS

Figure 1:
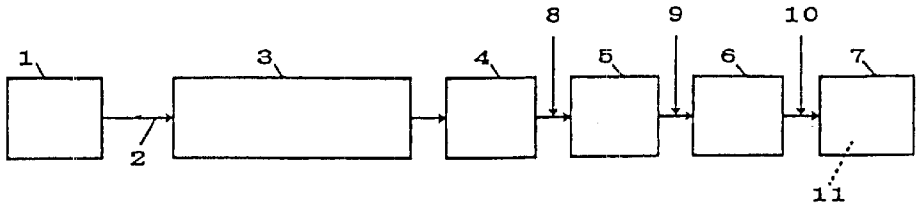
FIG. 1 is a schematic side view schematically showing an apparatus for producing a precursor fiber bundle in accordance with the present invention.

The following description is directed to specific forms of the invention selected for illustration in the drawings. It is not intended to define or to limit the scope of the invention, which is defined in the appended claims.

The precursor fiber bundle of the present invention is, as described, specially constituted to maintain the form of a single tow when packed in a container, and potentially can be divided into two or more sub-tows when taken out of the container, to be subjected to stabilizing.

The precursor fiber bundle is produced, for example, by a process as shown in FIG. 1.

In a spinning step 1, a plurality of filaments are spun from a spinnerette. The spinning method is not especially limited, and may be, for example, any known wet spinning in which many filaments are spun from a spinnerette and coagulated in a coagulating bath, for example. The plurality of spun filaments are divided into a plurality of sub-tows each of which comprises a predetermined reduced number of filaments. This division is carried out in the coagulating bath, or desirably at the outlet of the coagulating bath in the case of wet spinning. The division may be practiced by using a dividing bar, for example. FIG. 1 does not illustrate the divided tows since it is a side view. When the process is viewed from above, the divided arrangement can be identified.

Figure 2:
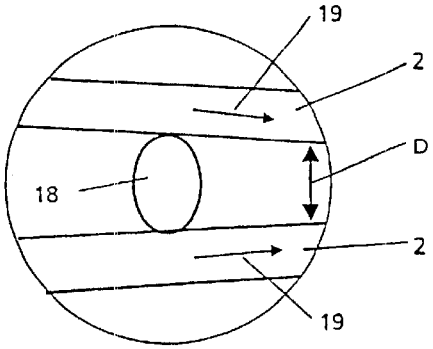
FIG. 2 is a plan view showing a typical portion of running and divided sub-tows in a coagulating bath in the spinning step performed by a portion of the apparatus shown in FIG. 1.

FIG. 2 is a plan view showing typically a portion of the separate running of the divided sub-tows in the coagulating bath of FIG. 1. In FIG. 2, it is shown that the spun multifilament is divided into the plurality of sub-tows 2, 2 by the dividing bar 18 having an elliptical cross section. The divided tows run in the direction shown by arrows 19, 19 in FIG. 2.

The group 2 of sub-tows comprising a plurality of sub-tows divided from the spun multifilament is fed to a filament drawing step 3 (FIG. 1) and a finish oiling step 4 in a divided configuration.

In this example, the sub-tow group 8 (FIG. 1) delivered from the oiling step 4 is fed to a crimping step 5 where the sub-tow group 8 is crimped. Each of the sub-tows in the sub-tow group 8 is collected into the form of one tow 9 (FIG. 1). This convergence of sub-tows is brought about with weak entanglment of filaments located in the side edge portions of each of the adjacent sub-tows as a result of the crimping. This entanglement, extending the length direction of the filaments at their side edge portions, is weak. Therefore, the fiber bundle formed as a single tow 9 can be re-divided into sub-tows forming the sub-tow group 8 (FIG. 1) at the side edge portions of the sub-tows. That is, the precursor fiber bundle 10 (FIG. 1) in the form of a single tow delivered from a drying step 6 (FIG. 1) subsequent to the crimping step 5 has potential dividability into a plurality of sub-tows.

The precursor fiber bundle 10 thus formed is packed in a can 12 (FIG. 3) in a packing step 7 (FIG. 1).

In producing the precursor fiber bundle shown in FIG. 1, it is also possible to divide a spun multifilament into a plurality of groups 8 each of which comprises a plurality of sub-tows for preparing a plurality of precursor fiber bundles 9 in parallel, each of which bundles 9 is dividable into a plurality of sub-tows in the desired number. Parenthetically, a bale may be used instead of a can as the container for packing the precursor fiber bundle 10.

The precursor fiber bundle 11 so produced is sent to a carbon fiber production process, shown as packed in the can 12. It is once packed in a container because the process for producing the precursor fiber bundle has a greatly different fiber processing speed than the process for producing the carbon fibers.

Figure 3:
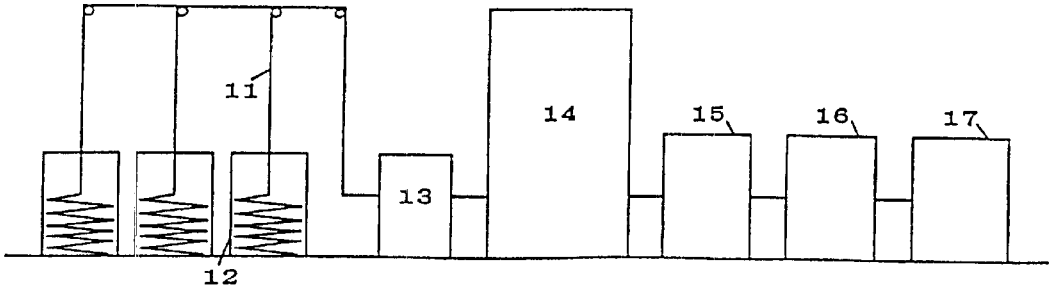
FIG. 3 is a schematic side view showing an apparatus for practicing a process for producing carbon fibers according to the present invention.

A carbon fiber bundle can be produced, for example, according to the process shown in FIG. 3.

The precursor fiber bundle 11 is supplied as packed in the can 12. Where processing simultaneously a plurality of the precursor fiber bundles 11, as many cans as necessary are prepared (shown as three in number, in FIG. 3).

Each precursor fiber bundle 11 taken out of the can 12 is divided into sub-tows in a dividing step 13 upstream of a stabilizing furnace 14. The division can be practiced using, for example, a grooved roll or dividing bar. Since the sub-tows are collected or converged with weak side edge portion entanglements, such division can be accomplished very easily. In the division step, very little fuzz formation or fiber breakage occur.

Each divided sub-tow is stabilized in the stabilizing step 14. Stabilization is effected by heat treatment in an oxidizing atmosphere having a temperature in the range of about 200° C. to about 350° C. in the stabilizing furnace 14. Since each of sub-tows has a predetermined relatively small size, excessive heat storage does not occur, and the fiber breakage and the adhesion between filaments during the stabilizing treatment can be, and are prevented.

The stabilized sub-tows are then fed to a carbonizing step 15 and further, as required, to a surface treatment step 16 such as a sizing step, and formed as a carbon fiber bundle, wound in a winding step 17. Since the stabilizing treatment is effected against sub-tows each of which has a controlled and proper reduced thickness, the carbon fibers obtained are excellent in strength and elastic modulus.

It is preferable that the precursor fiber bundle has a total fineness of from about 300,000 denier to about 1,500,000 denier, more preferably from about 400,000 denier to about 1,200,000 denier, and it is preferable that each of the sub-tows finally obtained from the precursor fiber bundle having potential dividability has a fineness of from about 50,000 denier to about 250,000 denier, more preferably from about 80,000 denier to about 150,000 denier.

If the precursor fiber bundle has a fineness of less than about 300,000 denier, the degree of entanglement between filaments is likely to be less than about 10 $m^{-1}$, and the degree of entanglement of the filaments is low. Such low entanglement causes deformation of tow; where such tow is stabilized irregular tension occurs due to dislocation between filaments, causing fiber breakage.

If the total fineness is more than about 1,500,000 denier, the adhesion between filaments becomes strong, increasing drawing nonuniformity and fiber breakage, thus lowering the productivity in filament drawing and carbonization. If fineness of each of the divided sub-tows is less than about 50,000 denier, the productivity in the carbonizing step is too low. If it is more than about 250,000 denier, irregular carbonization occurs and lowers quality.

If the precursor fiber bundle is crimped, adhesion between filaments is likely to be removed and the strength of carbon fibers is likely to be manifested. A desirable number of crimps of the zig-zag type is in the range of about 8 peaks per 25 mm to about 13 peaks per 25 mm, preferably from about 10 peaks per 25 mm to about 12 peaks per 25 mm. If it is less than about 8 peaks per 25 mm, the adhesion between filaments is likely to persist, and the strength of carbon fibers is unlikely to be manifested. If more than about 13 peaks per 25 mm, the filaments tend to buckle, reducing strength.

The number of crimp is effectively measured as a mean value of 20 measuring samples, each number being measured as follows. A single filament as a sample is taken out of a precursor fiber bundle and is weight 2 mg/d. The number of peaks of crimp in the weighted sample is counted over a predetermined length taking along the straight lengthwise direction of the sample, and the result is converted to a length of 25 mm.

The precursor fiber bundle in the present invention can also be a non-crimped tow (a straight tow having substantially no crimp.) In the case of the non-crimped tow, since the degree of entanglement of filaments is very small, it is desirable to cause the filaments to contain moisture for enhancing the collectability. The moisture content in this case is desirably in the range of about 10% to about 50%. If less than about 10%, collectability is too low, and if more than about 50%, the packing rate may become too low.

The moisture content is obtained by the equation: $(10-B)\times 100/B$, where B is the weight obtained by the following measurement. A tow of 10 g as a sample is taken out of a precursor fiber bundle, dried with a hot-air dryer for 2 hours at 105° C., and placed in a dessicator containing a drying agent for 10 minutes, and the weight of the sample is measured. The observed value of the weight is used as B in the above equation.

Figure 4:
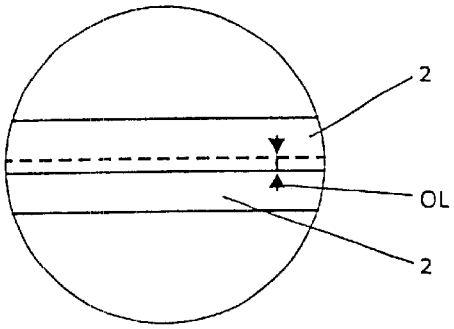
FIG. 4 is a plan view showing a portion of typical running sub-tows collected as a single tow in the apparatus shown in FIG. 1.

In the process for producing a precursor fiber bundle, after spinning a polymer solution through a spinnerette for forming a multifilament and coagulating the spun multifilament, the multifilament can be divided as desired. It is preferable that the dividing bar used in this case does not allow any substantial frictional force to act on the tow, and not to damage the tow as much as possible, but the dividing bar is not especially limited as to material or form. However, the width of the dividing portion of the bar is important. It is preferable that the dividing portion has such a width as to ensure that the side edge portions of adjacent divided sub-tows overlap each other by about 1 mm when they are finally collected as a tow, if the tow is a non-crimped tow or a crimped tow. It is preferable that the guide width ensures that the side edge portions of the adjacent sub-tows are engaged with each other by about 1 mm before they are crimped. If such a divided state cannot be ensured by the division in the coagulating step only, a further dividing operation may be added in another step, to control the side edge portions of the adjacent sub-tows to engage with each other by about 1 mm, before they are crimped. The cross section of the dividing bar is preferably formed as ellipsoidal or rhombic, etc. and as small as possible in contact area, to ensure that the filaments constituting the tow are not significantly rubbed or damaged by the dividing bar. Especially in the case of a bar having an ellipsoidal cross section, it is preferable to place the major axis and the running direction of tow at a substantially right angle. Such a relationship is shown in FIG. 2 (dividing bar 18). FIG. 4 is a plan view showing typically the state of overlapping, where the overlapping is labeled with the mark OL.

For example, when a tow is divided into sub-tows each of which has a fineness of about 50,000 deniers or more, the running space, which is shown with the mark D in FIG. 2, between adjacent sub-tows divided in the drawing step is preferably in the range of about 1.5 cm to about 2 cm. If less than about 1.5 cm, the adjacent divided sub-tows tend to engage too intensively with each other at their side edge portions. This causes an increase of fiber breakage and fuzz generation when the two is re-divided in the stabilizing step. Further, it causes trouble in carbonizing and reduces the quality of the carbon fiber bundle. If this running space is more than about 2 cm, the sub-tows are less firmly engaged with each other at their side edge portions, and the sub-tows are taken up irregularly when forming the non-crimped tow, or in a step of forming the crimped tow, and it causes dislocation of filaments in the longitudinal direction. Furthermore, the tow itself is deformed.

The following Examples are illustrative of the invention. They were performed by us, or by others working under our supervision, and all reported results are true and correct to the best of our knowledge and belief.

EXAMPLES 1 TO 10, AND COMPARATIVE EXAMPLE 1

A dimethyl sulfoxide (DMSO) solution of an acrylic polymer consisting of acrylonitrile (AN)/methyl acrylate (MEA)/sodium methacrylsulfonate (SMAS)/itaconic acid (IA) 93.5/5.5/0.5/0.5 (by weight) was introduced into 60% DMSO aqueous solution of 30° C., and a fiber bundle of 400,000 denier was wet-spun, and divided into four sub-tows each of which has a fineness of 100,000 denier at the outlet of the coagulating bath. In this process, an elliptical dividing bar 18 (see FIG. 2) having a length of the major axis (LMA) of 1.5 cm was used in Example 1, a length of the major axis of 1 cm was used in Example 2, and a length of the major axis of 2.5 cm was used in Example 3. They were drawn, washed with water, oiled, and crimped with a conventional stuffing box type crimper. In Comparative Example 1, the fiber bundle was not divided during the coagulating step but divided only just before it was crimped.

Non-crimped sub-tows obtained after washing with water in Example 1 were treated with finish-oil to adjust their moisture contents of 2.5%, 40% and 60% respectively in Examples 4, 5 and 6.

A fiber bundle of 270,000 deniers was wet-spun and divided into three sub-tows each of which had a fineness of 90,000 denier at the outlet of the coagulating bath. In this process, as Example 7 an elliptical dividing bar 18 (see FIG. 2) having a length of the major axis of 1.5 cm was used. A fiber bundle of 400,000 denier was wet-spun and divided into 10 sub-tows each of which has a fineness of 40,000 denier at the outlet of the coagulating bath. In this process, as Example 8 an elliptical dividing bar 18 (see FIG. 2) having a length of the major axis of 1.5 cm was used. A fiber bundle of 1,600,000 denier was wet-spun and divided into 16 sub-tows each of which has a fineness of 100,000 denier at the outlet of the coagulating bath. In this process, as Example 9 an elliptical dividing bar 18 (see FIG. 2) having a length of the major axis of 1.5 cm was used. A fiber bundle of 1,600,000 denier was wet-spun and divided into 40 sub-tows each of which has a fineness of 40,000 denier at the outlet of the coagulating bath. In this process, as Example 10 an elliptical dividing bar 18 (see FIG. 2) having a length of the major axis of 1.5 cm was used. In Examples 7–10, the sub-tows were respectively drawn, washed with water, oiled, crimped and dried. Sample having a length of 5,000 m was taken in each of Examples 1–10 and Comparative Example 1 for evaluating dividability, the degree of entanglement and adhesion. The results are shown in Table 1.

The methods for evaluating the respective properties in the examples were as described below.

(i) Dividability:

For evaluating the dividability, a crimped tow 5,000 m long was divided manually from end to end. A sample which was poor in dividability and had to be divided forcibly by scissors, etc. was designated as "Δ"; a sample which could not be divided due to fiber breakage or defective division was designated as "x"; and a sample which could be simply manually divided over the entire length was designated as "○".

(ii) Degree of entanglement of a precursor fiber bundle, measured according to the hook drop testing method:

A precursor fiber bundle (tow) was hung on a horizontal setting bar with a fineness of 20,000 denier/cm and fixed at the upper end portion of the bundle on the bar with an adhesive tape. On the lower end portion, a weighing bar of 20 g/10,000 denier was fixed with an adhesive tape. A wire having a diameter of 1 mm and its tip portion having a length of 2 cm bent at right angle, and carrying fixed a weight of 100 g at its lower end, was prepared. The wire was hooked on the hanging bundle with the bent tip portion and allowed to fall in downwardly freely. The falling distance X (in meters) of the wire until the hook engaged the tangle was measured. Such falling distance X (in meters) was measured at 20 different positions with a substantially equal interval along the width of the hung bundle. The mean value (Xm) of the 20 measuring data (X) was calculated. The degree (CFP) (in 1/mm=$m^{-1}$) of entanglement of a precursor fiber bundle was obtained by the following formula.

$$\text{Degree of entanglement (CFP)} = 1/Xm$$

(iii) Adhesion:

A volume of filaments having a length of 5 mm which was obtained by cutting a precursor fiber bundle was prepared as a measuring sample so that the volume was equal to about 10,000 filaments in a precursor bundle (where the fineness of single filament is 1.5 denier, the volume become 0.0084 g). A rotor and 100 ml of 0.1% Noigen SS were put into a beaker, and the sample was added. They were stirred by a magnetic stirrer for 1 minute, and the mixture was suction-filtered using black filter paper, to visually judge the dispersibility of fibers in reference to six grades. The 1st grade is the best in adhesion and the 6th grade, the worst.

As described above, according to the present invention, a precursor fiber bundle can maintain the form of one tow when packed in a container, and can be easily divided in the crosswise direction into sub-tows each of which has a desired fineness when used for producing carbon fibers (when supplied to the stabilizing step). So, a thick (large in fineness) precursor fiber bundle can be produced at a very high productivity, and in the carbon fiber production process, it can be divided into sub-tows each of which has a predetermined thickness to allow stable stabilizing treatment. Therefore, both an improvement in productivity of the precursor fiber bundle and the stable production of carbon fibers having an excellent properties can be simultaneously achieved, which contributes significantly to reduction of cost for producing carbon fibers.

EXAMPLES 11 TO 13 AND COMPARATIVE EXAMPLES 2 TO 6

Example 11

92.3 wt % of acrylonitrile, 6.3 wt % of methyl acrylate and 1.4 wt % of itaconic acid were polymerized in a nitrogen gas atmosphere at 60° C. for 11 hours and furthermore at 73° C. for 9 hours by solution polymerization with dimethyl sulfoxide as the solvent. The polymer solution obtained as a spinning dope was 22.5% in concentration and 240 cps in viscosity. It was extruded from a spinnerette that had 70,000 holes of 0.055 mm in diameter into 55% dimethyl sulfoxide aqueous solution of 40° C., to be coagulated. The fiber bundle obtained was drawn to 5 times in hot water while being washed, subsequently oiled, dried and densified by a drying drum, and treated to be shrunken by 15% in 113° C. air, to obtain a precursor fiber bundle, made of an acrylic polymer and of 1.5 d in filament fineness. Then, it was stabilized in air at 210° C. to 250° C., and heated up to 1,400° C. in nitrogen atmosphere, to obtain carbon fibers. In succession, they were electrolyzed at 10 coulombs/g with a sulfuric acid aqueous solution of 0.1 mole/liter in concentration as the electrolyte, washed with water and dried in 150° C. air. The carbon fibers obtained here were impregnated with an epoxy resin according to the method specified in JIS R 7601, to measure the tensile strength and elastic modulus of the strand by a tensile tester. The conditions in this case and the physical properties of the resulting carbon fibers are shown in Tables 2a and 2b. It can be seen that even with low tension during stabilization, the physical properties of the resulting carbon fibers are very good.

Example 12

Carbon fibers were obtained as described in Example 11, except that 96.1 wt % of acrylonitrile, 3.2 wt % of methyl acrylate and 0.7 wt % of itaconic acid were polymerized, and that the shrinkage percentage was 7%. The conditions in this case and the physical properties of the obtained carbon fibers are shown in Tables 2a and 2b.

Example 13

Carbon fibers were obtained as described in Example 11, except that 86 wt % of acrylonitrile, 10 wt % of methyl acrylate and 4 wt % of itaconic acid were polymerized, and that the shrinkage percentage was 18%. The conditions in this case and the physical properties of the obtained carbon fibers are shown in Tables 2a and 2b.

Comparative Examples 2 and 3

Carbon fibers were obtained as described in Example 11, except that 99.3 wt % of acrylonitrile and 0.7 wt % of itaconic acid were polymerized, and that the shrinkage percentage was 5%. The conditions in this case and the physical properties of the obtained carbon fibers are shown in Tables 2a and 2b. Since the monomer as the second component (group A) was not contained, the physical properties of carbon fibers were poor when the tension during stabilization was low.

Comparative Example 4

Carbon fibers were obtained as described in Example 11, except that the fiber bundle was drawn in a bath and in steam by 12 times in total. The conditions in this case and the physical properties of the obtained carbon fibers are shown in Tables 2a and 2b.

Comparative Example 5

Carbon fibers were obtained and evaluated as described in Example 12, except that the drawn fiber bundle was not treated to be shrunken. The results are shown in Tables 2a and 2b.

Comparative Example 6

Carbon fibers were obtained as described in Example 12, except that the drawn fiber bundle was treated to be shrunken by 2%. The results are shown in Tables 2a and 2b.

The methods for evaluating the properties in the examples were as described below.

(iv) Fuzz Generation:

From a precursor fiber bundle, ten 1 m long samples were taken. From each of the samples, a fiber bundle consisting of 1,000 filaments to 2,000 filaments was divided and taken, and the number of particles of fuzz in a length range of 0.5 m at the center was counted on an illuminated cloth inspection table. The mean value of 10 samples was calculated in numbers/in 10K (number of fuzz particles existing in 10,000 filaments of 1 m in length), and the value was adopted as the fuzz generation number. The fuzz generation number of the precursor fiber bundles made of an acrylic polymer used in Examples 11 to 13 were 8 to 9 numbers/in 10K.

(v) Degree of entanglement of carbon fiber bundle measured according to the hook drop testing method as described herein:

A carbon fiber bundle was hung on a horizontal setting bar and fixed at the upper end portion of the bundle on the bar with an adhesive tape. On the lower end portion, a weight bar of 200 g was fixed with an adhesive tape. A crochet needle with a weight of 10 g was pierced through the carbon fiber bundle, and the crochet needle free drop distance X (in cm) until stopped by fibers was measured 50 times. Of the measured values, the 10 largest values and the 10 smallest values were excluded, and the mean value Xm (in cm) of the remaining measured values was used, to obtain the degree of entanglement (CFC) (in 1/in $=m^{-1}$) of the carbon fiber bundle according to the hook drop testing method, using the following formula:

$$\text{Degree of entanglement (CFC)}=100/Xm$$

TABLE 1

| | LMA of Dividing bar (cm) | Moisture Content (%) | Dividability | Degree of Entanglement | Adhesion (grade) | Productivity of Carbonization |
|---|---|---|---|---|---|---|
| Example 1 | 1.5 | — | ○ | 22.2 | 1.5 | ○ |
| Example 2 | 1.0 | — | Δ | 17.3 | 1.5 | ○ |
| Example 3 | 2.5 | — | ○ | 28.3 | 1.5 | ○ |
| Example 4 | 1.5 | 2.5 | ○ | 8.3 | 3.0 | Δ |
| Example 5 | 1.5 | 40 | ○ | 11.9 | 3.0 | ○ |
| Example 6 | 1.5 | 60 | ○ | 13.4 | 3.0 | Δ |
| Example 7 | 1.5 | — | ○ | 8.2 | 1.5 | Δ |
| Example 8 | 1.5 | — | ○ | 23.4 | 1.5 | Δ |
| Example 9 | 1.5 | — | Δ | 42.5 | 6.0 | Δ |
| Example 10 | 1.5 | — | Δ | 43.5 | 6.0 | Δ |
| Comparative Example 1 | dividing just before crimping: could not be divided due to too often fiber breakage | | x | — | — | — |

TABLE 2a

| | Stabilization | | | |
|---|---|---|---|---|
| | Temperature (° C.) | Time (min) | Drawing Ratio | Tension (mg/d) |
| Example 11 | 225/230/245/252 | 110 | 1.2 | 95 |
| Example 12 | 225/230/245/252 | 110 | 1.2 | 100 |
| Example 13 | 215/225/235/245 | 180 | 1.3 | 80 |
| C-Example 2 | 225/230/245/252 | 110 | 1.0 | 140 |
| C-Example 3 | 225/230/245/252 | 110 | 0.95 | 110 |
| C-Example 4 | 225/230/245/252 | 110 | 1.0 | 135 |
| C-Example 5 | 225/230/245/252 | 110 | 1.0 | 140 |
| C-Example 6 | 225/230/245/252 | 110 | 1.0 | 130 |

(C-Example: Comparative Example)

TABLE 2b

| | | Physical Properties of Carbon Fibers | | |
|---|---|---|---|---|
| | Stabilization Number of Fuzz (particles/m 10 K) | Strength (GPa) | Elastic Modulus (GPa) | Degree of Entanglement ($^{-1}$m) |
| Example 11 | 8 | 3.5 | 230 | 30 |
| Example 12 | 8 | 3.5 | 250 | 30 |
| Example 13 | 9 | 3.4 | 230 | 30 |
| C-Example 2 | 30 | 3.6 | 250 | — |
| C-Example 3 | 9 | 2.9 | 220 | — |
| C-Example 4 | 22 | 3.5 | 250 | — |
| C-Example 5 | 25 | 3.5 | 250 | — |
| C-Example 6 | 14 | 3.5 | 250 | — |

(C-Example: Comparative Example)

What is claimed is:

1. A process for producing a precursor fiber bundle from multifilaments spun from a spinnerette comprising forming a group comprising a plurality of sub-tows each of which is separated from each other, drawing said sub-tows while separated from each other; collecting said drawn sub-tows and combining them into a single tow capable of being divided into said plurality of sub-tows; and packing said single tow into a container.

2. A process according to claim 1, wherein said sub-tows are combined by crimping in a form to allow division into said plurality of sub-tows.

3. A process according to claim 2, wherein said fiber bundle collected in the form of a single tow that is dividable into a plurality of sub-tows is a tow comprising an acrylic polymer having a total fineness in the range of from about 300,000 denier to about 1,500,000 denier, and the fineness of each of said sub-tows is in the range of from about 50,000 denier to about 250,000 denier.

4. A process according to claim 1, wherein (a) said fibers are of acrylic polymer consisting essentially of acrylonitrile, one or more unsaturated monomers of group A and one or more unsaturated monomers of group B; wherein (b) said one or more unsaturated monomers of group A is one or more unsaturated monomers selected from the group consisting of vinyl acetate, methyl acrylate, methyl methacrylate and styrene; wherein (c) said one or more unsaturated monomers of group B is one or more unsaturated monomers selected from the group consisting of itaconic acid and acrylic acid; wherein (d) the content AN (wt %) of said acrylonitrile in said acrylic polymer satisfies the following formula (1):

$$AB\ (wt\ \%) \geqq 86 \quad (1)$$

and wherein (e) the content A (wt %) of said unsaturated monomer(s) selected from group A in said acrylic polymer and the content B (wt %) of said unsaturated monomer(s) selected from group B in said acrylic polymer satisfy the following formulae (2) and (3):

$$3 \leqq A\ (wt\ \%) \leqq 10 \quad (2)$$

$$0.25A - 0.5 \leqq B\ (\text{wt}\ \%) \leqq 0.43A - 0.29 \quad (3).$$

5. A process according to claim 4, wherein said spun filaments are drawn at a ratio in the range of from about 2 times to about 8 times, and are in succession shrunken in the range of from about 5% to about 18%.

6. A process for producing carbon fibers, comprising the steps of dividing into sub-tows a precursor fiber bundle comprising a multiplicity of elongated polymeric filaments capable of being formed as a single tow when packed in a container and capable of being divided in crosswise direction into a plurality of sub-tows when taken out of said container, to be used for producing carbon fibers, supplying said divided sub-tows and feeding each sub-tow into a stabilizing process, treating said sub-tows for stabilization; and supplying resulting stabilized tows into a carbonizing process, to treat them for carbonization.

7. A process for producing carbon fibers, according to claim 6, wherein said stabilizing process is carried out in an oxidizing atmosphere having a temperature in the range of from about 200° C. to about 300° C. and wherein said carbonizing process is carried out in an inactive atmosphere having a temperature in the range of from about 500° C. to about 1,500° C.

8. A process for producing carbon fibers from a bundle, comprising a multiplicity of elongated polymeric filaments capable of being formed as a single tow when packed in a container and capable of being divided in crosswise direction into a plurality of sub-tows when taken out of said container, to be used for producing carbon fibers, wherein said acrylic polymer consists of acrylonitrile, one or more unsaturated monomers of group A and one or more unsaturated monomers of group B; wherein said unsaturated monomers of group A are selected from the group consisting of vinyl acetate, methyl acrylate, methyl methacrylate and styrene; and said unsaturated monomers of group B are selected from the group consisting of itaconic acid and acrylic acid; and wherein the content AN (wt %) of said acrylonitrile in said acrylic polymer satisfies the following formula (1):

$$AB\ (wt\ \%) \geqq 86 \quad (1)$$

and wherein the content A (wt %) of unsaturated monomer (s) selected from group A in said acrylic polymer and the content B (wt %) of said unsaturated monomer(s) selected from group B in said acrylic polymer substantially satisfy the following formulae (2) and (3):

$$3 \leqq A\ (wt\ \%) \leqq 10 \quad (2)$$

$$0.25A - 0.5\ B\ (wt\ \%) \leqq 0.43A - 0.29 \quad (3)$$

comprising the steps of:

processing said bundle by dividing it into a plurality of sub-tows, introducing said sub-tows into a stabilizing treatment process, stabilizing said separate tows, supplying resulting stabilized tows into a carbonizing treatment process and carbonizing said stabilized tows, said stabilizing treatment process being carried out under the following conditions:

(a) said stabilizing treatment time is in the range of from about 45 minutes to about 180 minutes, (b) a drawing ratio of said tows is in the range of from about 0.9 to about not larger than D as defined by $$D = 1 + (Dmax - 1) \times 0.6$$

where Dmax is the maximum drawing ratio, and (c) a tension T of said tows satisfies $30 \leqq T\ (mg/d) \leqq 120$.

9. A process according to claim 8, wherein said stabilizing process is carried out in an oxidizing atmosphere having a temperature in the range of from about 200° C. to about 300° C. and said carbonizing process is carried out in an inactive atmosphere having a temperature in the range of from about 500° C. to about 1,500° C.

* * * * *